United States Patent [19]

Fessell

[11] Patent Number: 5,042,698

[45] Date of Patent: Aug. 27, 1991

[54] EASY POUR SPOUT

[76] Inventor: Eric Fessell, 1144 Gandy Crest Dr., St. Petersburg, Fla. 33702

[21] Appl. No.: 487,288

[22] Filed: Mar. 2, 1990

[51] Int. Cl.[5] ..... B67D 3/00

[52] U.S. Cl. ..... 222/481.5; 222/484; 222/559; 141/294; 141/354; 141/355

[58] Field of Search ..... 141/294, 293, 292, 291, 141/355, 354, 353, 352, 357, 335; 222/518, 519, 520, 559, 153, 481.5, 484, 523, 524, 525, 532

[56] References Cited

U.S. PATENT DOCUMENTS

| | | | |
|---|---|---|---|
| 1,182,716 | 5/1916 | Sexton | 222/518 |
| 1,335,800 | 4/1920 | Smith | 141/353 |
| 2,992,761 | 7/1961 | Sommers, Sr. | 222/525 X |
| 3,207,190 | 9/1965 | Silbereis et al. | 222/484 X |
| 3,399,811 | 9/1968 | Miller | 222/484 X |
| 4,667,710 | 5/1987 | Wu | 141/292 X |
| 4,903,742 | 2/1990 | Gagnon | 141/293 X |
| 4,924,921 | 5/1990 | Simmel et al. | 141/293 X |

*Primary Examiner*—Michael S. Huppert
*Assistant Examiner*—Anthoula Pomrening
*Attorney, Agent, or Firm*—Walter J. Monacelli

[57] ABSTRACT

The easy pour spout described herein is designed to facilitate the pouring of a fluid from its container, such as oil for the engine, power steering and transmission of an automobile as well as radiator antifreeze, without the use of a funnel. The spout is designed as a totally self-contained unit that facilitates fast delivery into the desired part of the automobile without spilling. This spout is screwed onto the individual fluid container and after the spout and container are positioned for delivery, the delivery is actuated by a downward thrust on the container and spout.

11 Claims, 3 Drawing Sheets

EASY POUR SPOUT

BACKGROUND OF THE INVENTION

1. Field of the Invention

This invention relates to a specifically designed spout for delivering oil or other fluid from its original container to the desired part of an automobile. More specifically this spout facilitates the delivery of the fluid from the container to the automobile without gurgling or spilling. Still more specifically the spout is designed to have the spout and the container in delivery position before the delivery passageway is cleared for delivery of the fluid. Still more specifically the action to clear the passageway for fluid delivery is a simple downward thrust on the container and spout.

2. State of the Prior Art

There are a number of patents describing various devices for facilitating the pouring of liquid from a container. These include: U.S. Pat. Nos. 326,747; 1,274,867; 3,225,970; 3,776,433; 4,588,111; 4,802,610 and 4,804,117. The considerable number of these patents indicate the desire to overcome the difficulties of pouring liquids from containers.

In 1885, U.S. Pat. No. 326,747 attempted to cure this problem with a cap which provides an outlet at the side of the cap.

U.S. Pat. Nos. 1,274,867, 3,225,970 and 3,776,433 describe screw caps which have two outlets, one on opposite side from the other. Each of these provide for pouring of the contents while the container is held in a substantially horizontal position.

U.S. Pat. No. 4,588,111 shows a spout equipped with a venting tube, again adapted to have the fluid flow while the container is at least initially in a substantially horizontal position.

U.S. Pat. No. 4,802,610 shows a spout assembly with a vent tube which delivers the fluid at the side of the spout and also requires a pull out action to clear the passageway for fluid flow. With this design the container is not inverted for fluid delivery until after the passageway is cleared for delivery. Therefore while the container is being inverted, the passageway is open for fluid flow while the container is being put into position for fluid delivery.

U.S. Pat. No. 4,804,117 describes a spout for pouring out small amounts from the container with a delivery tube which is squeezed when it is desired to have the flow cut off.

None of these patents show a spout which will permit the container to be inverted into a delivery position, to be supported and balanced on the receptacle or other part into which delivery of the fluid is to be made, and that clearance of the passageway and initiation of fluid delivery is effected simply by a downward thrust on the container and spout.

OBJECTIVES

It is an object of this invention to provide a spout which may be connected to a fluid container to facilitate the flow of fluid therefrom without gurgling and spilling.

It is also an object of this invention to provide such a spout which can be actuated for fluid flow after the container and spout have been positioned for fluid delivery.

It is also an object of this invention to have the fluid delivery actuated by a simple downward thrust on the container and spout after they have been placed in the delivery position.

It is also an object of this invention that such a spout may be made inexpensively and if desired it may be a throw-away item or may be used repeatedly.

It is also an object of this invention that the spout may be securely fastened to the container such as by screw-on threads.

It is also an object of this invention that the spout and container may be rested and securely balanced on the receptable during the delivery procedure.

It is also an object of this invention that the flow of fluid may be prevented and sealed during the attachment and positioning procedures.

Other objects will become obvious upon reading the detailed description of the invention as given hereinafter.

SUMMARY OF THE INVENTION

In accordance with the present invention, an easy pouring spout is described herein which meets all the above objectives. This spout comprises a number of parts which, when assembled and screwed onto the threaded neck of the fluid container, is ready for delivery of the fluid contents of the container. This spout has a first cylindrical tube which has ports at the lower region thereof and a threaded exterior at the lower end thereof. Two arms extend perpendicularly from the upper exterior of this tube which have gripper teeth on the upper surface thereof and a slanted portion also on the upper surface of these arms adjacent to this tube. A cap is provided to cover the upper end of this tube. Seal rings are provided above and below the section where the ports are located. A vent tube portion is provided inside the first cylindrical tube with both ends thereof extending through openings in the wall of the first cylindrical tube extending to the outside of the tube. The lower portion of this cylindrical tube is adapted to fit into an opening in the top of a screw-on cap. Arms are extended sidewards from tube. The lower portion of this tube is adapted to fit into a lower or second tube which has two cutaways which act as guides for positioning these arms. Cutaway sections in the upper portion of this lower tube aid in positioning and holding the side arms extending from the first tube, and eventually allow lowering of the arms into the cutaways. A vent tube extends downward from the outside of the lower tube and extends through an opening in the cylindrical wall of the lower tube and has its upper end turned and positioned to abut and connect eventually with the lower end of the first vent portion. The shoulders of the lower tube have two stop-guides to prevent complete turning of the aforesaid side-arms. The side-arms are rested on the shoulders of the lower tube until it is desired to lower these arms into the cutaway sections. The stop guides prevent complete rotation of the arms on the top of the shoulders. Also on the first cylindrical surface are two buttons positioned so that when the arms are resting on the said shoulders, one button will be positioned to press into the open end at the top of the vent tube in the lower or second cylindrical tube. The second button is positioned to press into the same open end of the vent tube when the arms are positioned about the cutaways. This closing of the upper end of the vent tube traps air in the vent tube and thereby reduced the tendency of fluid to enter this vent tube when the spout is inserted into the neck of the container and until the top of this vent tube is moved toward the partial vent tube in the interior of the first cylindrical tube and joined therewith. A cap with threads on the inside thereof is designed to screw onto the threads of the lower end of the lower tube when the latter is passed downward through the lower tube. The threads on the inside of the screw-on cap are designed to be screwed onto the threads on the neck of the fluid container.

When the first tube is lowered into the interior of the lower or second tube, the side arms of the first cylindrical tube fit securely into the cutaways of the second cylindrical tube to secure the position. These arms are adapted to fit into the cutaways. When the assembled tubes are screwed onto the neck of the containers, the arms are at rest on the shoulders of the second cylindrical tube or in the upper region of the cutaways so the ports are not opened for fluid flow. Then the cap at the top of the first tube is removed, the joined container and spout are inverted, and the lower part of the spout, previously the upper part of the spout when upright, is inserted into the opening of the receptacle with the arms resting on the rim of the neck of the receptacle. When it is desired to initiate the flow of fluid from the container, the sidearms are positioned at the top of the cutaways and a downward thrust is applied on the inverted container so that the lower cylindrical tube moves more completely over the first cylindrical tube whereby the sidearms move completely into the cutaways of the second tube and the ports are moved into an open position so that fluid can flow from the container into the receptacle.

The description of the easy pour spout of this invention is facilitated by reference to the accompanying drawings in which.

Figure 1:
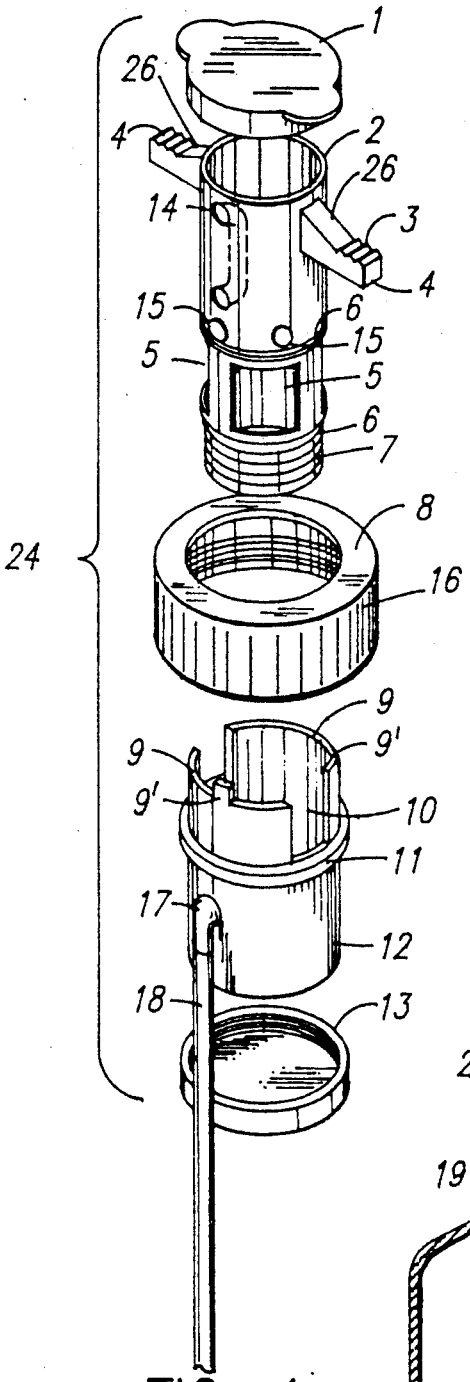
FIG. 1 is an exploded, perspective view of the various parts of the spout of this invention.
Figure 2:
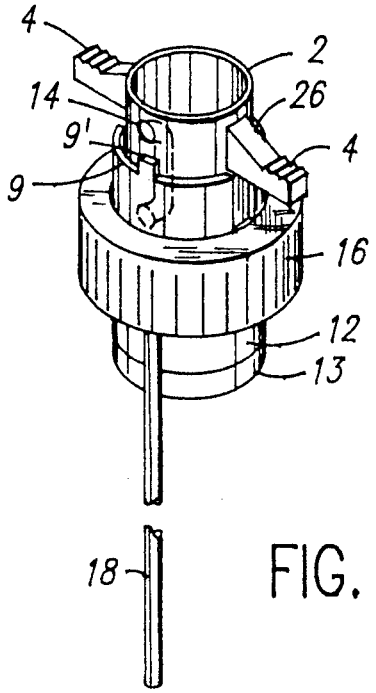
FIG. 2 is a perspective view of the spout of FIG. 1.
Figure 3:
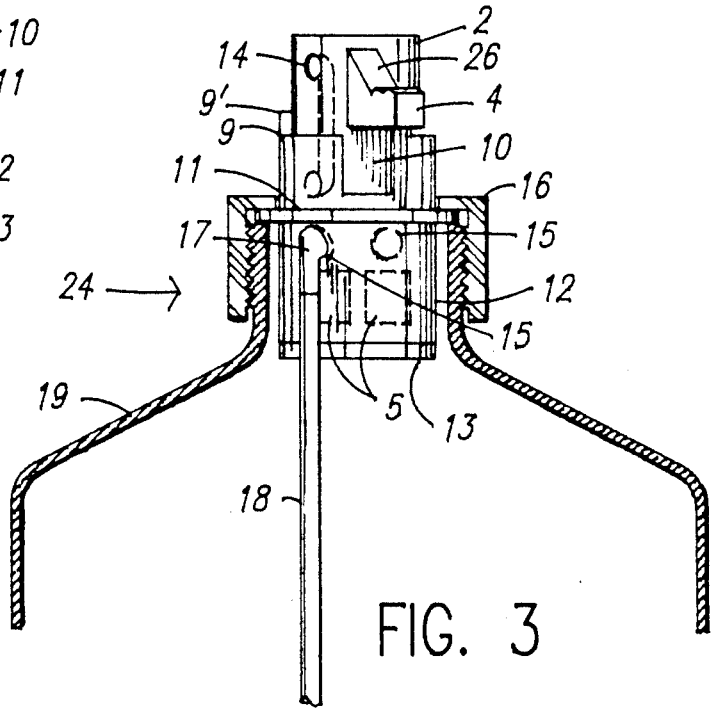
FIG. 3 is a partial cross-sectional of the spout of FIGS. 1 and 2 screwed onto the top of a container.

More specifically, the easy pour spout of this invention has a first cylindrical tube 2 which has ports 5 at the lower region thereof and a threaded exterior 7 at the lower end thereof. Two arms 4 extend perpendicularly from the upper exterior of tube 2 which has gripper teeth 3 on the upper surface of arm 4 and a slanted portion 26 also on the upper surface of arm 4 adjacent to tube 2. Cap 1 is provided to cover the upper end of tube 2. Seal rings 6 are provided above and below the section where ports 5 are located. Vent tube portion 14 is provided inside tube 2 with openings extending at the upper and lower ends thereof through tube 2. The lower portion of cylindrical tube 2 is adapted to fit into the opening in the top of screw-on cap 16. Arms 4 are adapted to rest on shoulder 9 of tube 12 or into cutaways 10. The lower portion of cylindrical tube 2 is adapted to fit into lower or second tube 12 which has two cutaways 10 which act as guides for positioning arms 4. Shoulders 9 are the remaining portion of the upper second tube 12 after cutaways 10 have been removed. Stop guides 9' are provided so that when arms 4 are rested on the shoulders 9, these stops 9' will prevent further rotation on these shoulders until it is desired to move the arms to the cutaways. Tube sections 9 in the upper portion of tube 12 aid in positioning and holding arms 4. Vent tube 18 extends downward from the outside of lower tube 12 and extension 17 passes through the cylindrical wall of tube 12 and has its upper end turned and positioned to abut and connect eventually with the lower end of vent tube portion 14. Buttons 15 are positioned on the cylindrical wall of tube 2 so that when arm 4 is resting on shoulder 9 next to stop guide 9', the upper opening of vent tube 17 will be opposite and snapped over one button 15 and when the arm is moved over cutaway 10, this end of 17 will be positioned and snapped onto the other button 15. The threads on the inside of cap 13 are designed to screw onto the threads of lower end 7 of tube 2 when the latter is passed downward through the lower tube. The threads on the inside of this screw-on cap 16 are designed to be screwed onto the threads on the neck of container 19. The lower or second cylindrical tube 12 has flange 11 which will rest on the upper edge of the neck of container 19 and will be secured tightly by screw-on cap 16.

Figure 5:
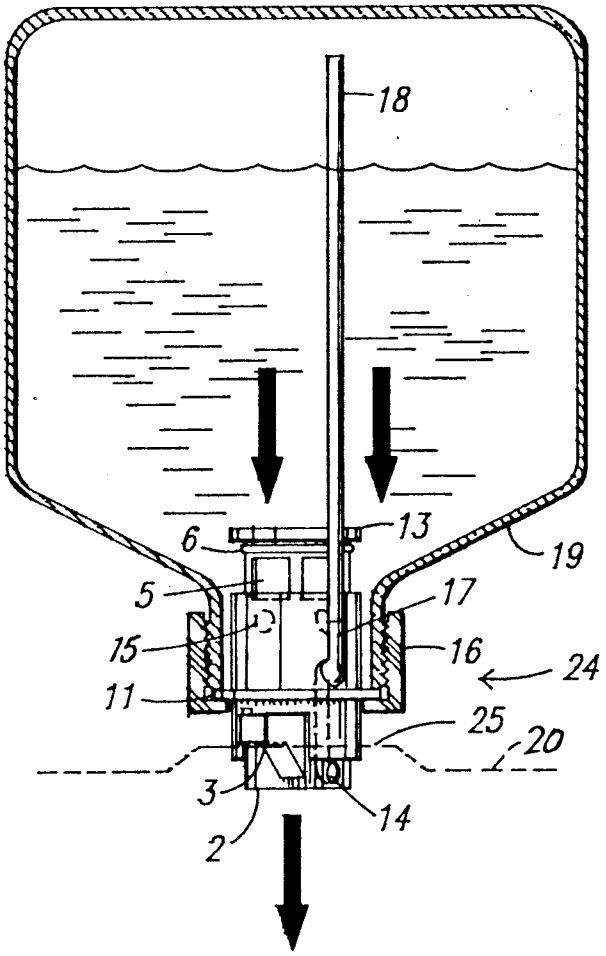
FIG. 5 is a view similar to that of FIG. 4 except that the ports are now clear or open for flow of fluid.
Figure 4:
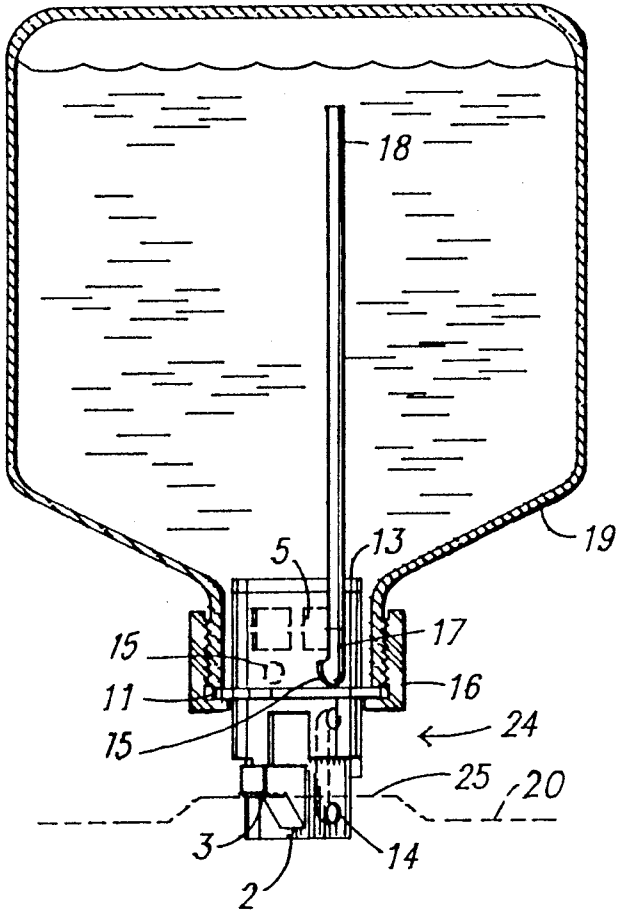
FIG. 4 is a partial cross-sectional view of the spout of FIGS. 1 and 2 connected to a container and in an inverted position, with ports not opened for flow of fluid.

When downward thrust is applied on container 19 in inverted position with the assembled spout 24 as shown in FIG. 4 where ports 5 are blocked from flow, the second tube 12 moves down to where ports 5 are cleared for free fluid flow as in FIG. 5 and the lower end 17 of vent tube 18 is moved into abutting and connecting position with respect to vent tube 14 so that air is passed above the fluid level in the inverted container 19. This venting or passing of air into the space above the fluid avoids a vacuum from forming and also avoids the gurgling that otherwise results. This venting operation provides a smoother and faster flow of fluid from the container into receptacle 20 through receptacle opening 25.

Figure 8:
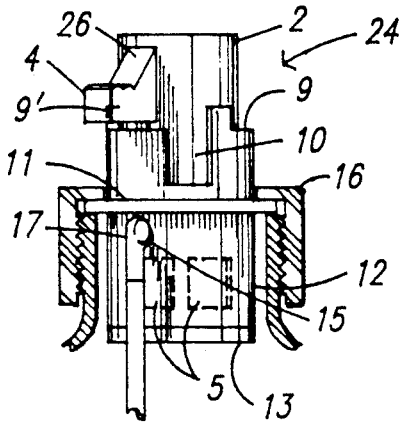
FIG. 8 is a broken section of the assembled spout of this invention in which sidearms extending from one part of the spout are resting on the shoulders of another part of the spout.

By the broken section shown in FIG. 8, arm 4 is shown positioned on the shoulder 9 of second cylindrical tube 12 so that arm 4 may not be accidently thrust into cutaway 10 and prematurely clear ports 5. Stop guide 9' prevents further movement or rotation of arm 4 on the shoulder 9.

Figure 9:
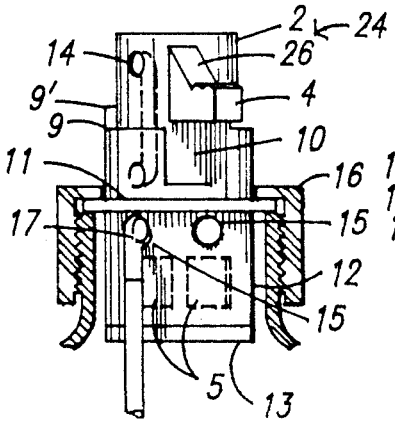
FIG. 9 is a second broken section of the assembled spout of this invention with these same sidearms positioned over cutaway sections in the other part of the spout.
Figure 10:
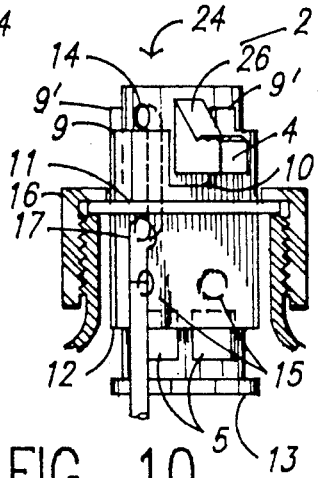
FIG. 10 is a third broken section of the assembled spout of the invention in which the sidearms are lowered into these cutaway sections.

A corresponding broken section shown in FIG. 9 shows arm 4 moved to a position above cutaway 10 and ready for movement of arm 4 into cutaway 10. FIG. 10 shows arm 4 moved completely into cutaway 10 whereby ports 5 have been cleared for flow of fluid from the container 19.

Figure 6:
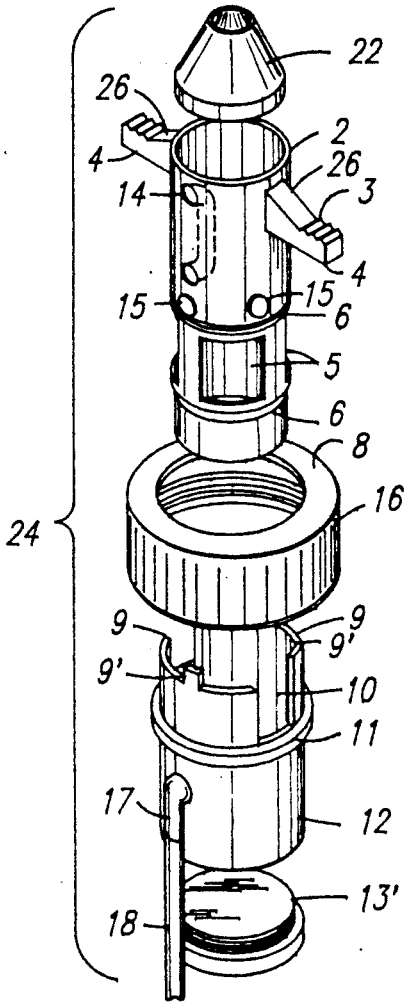
FIG. 6 is an exploded, perspective view of another modification of the spout of this invention in which an adaptor is positioned at the top of the spout so that when inverted, it will allow fluid flow into a narrower receptacle.

FIG. 6 shows another modification of the spout of this invention in which a different type of cap 13' is used at the bottom of second cylindrical tube 12 which has threads inside the bottom thereof to receive the threads of cap 13'. This modification shows an adaptor 22 with tapered end to fit into a transmission filler tube 23.

Figure 7:
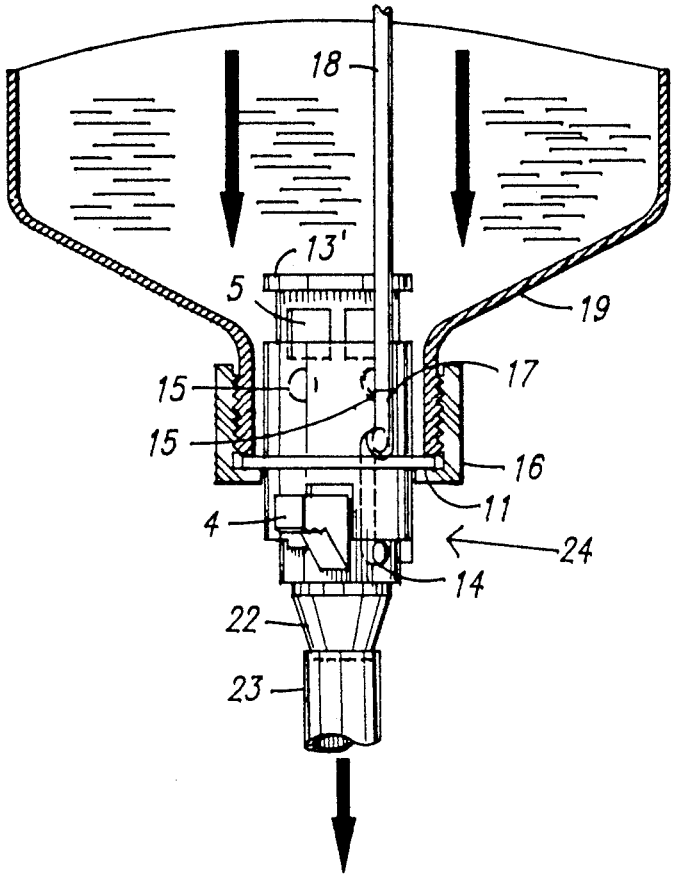
FIG. 7 is a partial cross-sectional view of the inverted spout of FIG. 6 connected to a container in fluid flow position into a narrower receptacle.

FIG. 7 shows the assembled spout of FIG. 6 positioned to deliver fluid from container 19 into the transmission filler tube 23.

The easy pour spout of this invention has numerous advantages. In view of the limited space generally available around the receptacle tube into which the oil or other fluid is to be introduced, it is important to be able to have the spout and the container in a vertical position when the fluid flow is initiated. This is an important feature of the spout of this invention. The spout can be placed in a vertical position and then by a downward thrust on the container the fluid flow is initiated. This avoids spillage that very often otherwise occurs.

Moreover the vent tube provided facilitates easy and rapid flow of fluid without the chugging or gurgling that generally occurs when a vacuum is created by the unvented flow of fluid from a container.

Furthermore the sidearms provide a secure balancing of the spout on the rim of the receptacle tube. The gripper teeth prevent slipping of the spout on the rim of the receptacle tube. Also the slanted portion on the sidearms also are capable of locking the spout in position. Most receptacle tubes have the upper edge turned over to form a rim extending inwardly. This rim generally has two slots, diametrically opposed to each other, to receive a spring catch underneath the cap which fits over the receptacle tube. The slanted portions of the sidearms are adapted to fit into these slots and thereby produce an additional locking effect that aids in preventing turning or slipping of the spout on the receptacle tube.

While two is the ideal number of arms protruding from the side of the first cylindrical tube, it is contemplated that only one such arm or more than two may be used.

Moreover while the bottom of the first cylindrical tube is shown as a removable cap, it is also contemplated that this may be a permanent bottom.

In summary of the description of the spout of this invention, it is a manually operable spout designed for engagement with the opening of a container having a threaded neck with an upper rim on this neck, with liquid in the container which is to be dispensed by use of the spout. This spout comprises (a) a first body portion having sidewalls (2) defining a first cylindrical cavity having at least one port opening (5) in these side walls near one end thereof and having near the other end thereof at least one arm (4) protruding outward from these sidewalls, this first valve body portion having a bottom (13) sealing the end thereof nearest the port opening; (b) a second valve body portion having sidewalls (12) defining a second cylindrical cavity having an inside diameter adapted to fit closely but movable in a longitudinal direction over the outer surface of the sidewalls of the first valve body portion, this second valve body portion having a number of cutaway sections (10) in the sidewalls at the end thereof that will be adjacent to the arms (4), the number of these cutaway sections being sufficient in number, shape and position to receive the arms protruding from the sidewalls of the first valve body portion, the second valve body portion having a length sufficient to cover the port openings (5) when the arms (4) are positioned outside the cutaway sections (10) and short enough not to cover these port openings when these arms are positioned within the cutaway sections, the second valve body portion also having a circular rim (11) encircling the outer surface thereof positioned near but spaced from the cutaway sections and having an outside diameter sufficient to bridge the opening in said container but not enough to extend beyond the neck on the container; and (c) a threaded cap having an opening therein adapted to receive and accommodate the outside of the wall of the second valve body portion and to rest on the circular rim (11) on the second valve body portion, the threaded portion of the cap being adapted to fit onto the threaded neck of the container whereby the rim of the second valve body is tightly fitted between the cap and the upper rim on the neck of the container when the cap is screwed tightly on the threaded neck.

An important auxiliary feature is a venting means comprising a first vent tube portion (14) in the first valve body portion having an opening extending through the sidewall of the first valve body portion at a level which will be exposed to the outside when the protruding arms are completely in the cutaway sections and the first vent tube portion (14) extending a distance therefrom to a second opening extending through the sidewall in the first valve body portion, and there is a second vent tube portion (18) in the second valve body portion positioned on the outside of the second valve body portion and extending in a direction substantially parallel to the longitudinal axis of the second cylindrical cavity in the second valve body, one end of this second vent tube being joined to an opening extending to the inside of the second cylindrical cavity, this opening being positioned so that it may be adjacent to and joined with the second opening in the sidewall of the first valve body portion when the arms (4) are positioned completely within the cutaway sections (10).

It is advantageous to have one but preferably two buttons on the outside surface of the first valve body portion, which buttons are positioned and have a size appropriate for snapping into the open end of the second tube extending through the sidewall of the second valve body portion when the open end of the second vent tube is positioned in juxtaposition thereto. These buttons are positioned in accordance with the positions of the end of the second vent tube before the arms (4) are thrust into cutaway sections (10).

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The invention claimed is:

1. A manually operable pour spout for engagement with the opening of a container having a threaded neck thereon with an upper rim on said neck and with liquid therein for use in dispensing said liquid from said container comprising:

(a) a first valve body portion having sidewalls defining a first cylindrical cavity having at least one port opening in said sidewalls near one end thereof and having at least one arm protruding outward from said sidewalls near the opposite end of said sidewalls, said first valve body portion having a bottom sealing the end thereof nearest said port opening;

(b) a second valve body portion having sidewalls defining a second cylindrical cavity having an inside diameter adapted to fit closely but movably in a longitudinal direction over the outer surface of the sidewalls of said first valve body portion, said second valve body portion having a number of cutaway sections in the sidewalls at one end thereof, the number of said cutaway sections being sufficient in number, shape and position to receive each said arm protruding from the sidewalls of said first valve body portion when said first valve body portion is inserted in said second valve body portion, said second valve body portion having a length sufficient to cover said port opening when each said arm is positioned outside a said cutaway section, and short enough not to cover said port opening when each said arm is positioned within a said cutaway section so as to extend radially through the sidewalls, said second valve body portion also having a circular rim encircling the outer surface thereof positioned near but spaced from said cutaway sections and having an outside diameter sufficient to bridge the opening in said container but not enough to extend beyond the neck on said container; and (c) a threaded cap having an opening therein adapted to accommodate the outside of said second valve body portion and to rest on said circular rim on said second valve body portion, the threaded portion of said cap being adapted to fit onto the threaded neck of said container whereby the rim of said second valve body portion is tightly fitted between said cap and the upper rim on said neck of said container when said cap is screwed tightly on said threaded neck.

2. The pour spout of claim 1 in which there are two said arms.

3. A manually operable pour spout for engagement with the opening of a container having a threaded neck thereon with an upper rim on said neck and with liquid therein for use in dispensing said liquid from said container comprising:

(a) a first valve body portion having sidewalls defining a first cylindrical cavity having at least one port opening in said sidewalls near one end thereof and having at least one arm protruding outward from said sidewalls near the opposite end of said sidewalls, said first valve body portion having a bottom sealing the end thereof nearest said port opening;

(b) a second valve body portion having sidewalls defining a second cylindrical cavity having an inside diameter adapted to fit closely but movably in a longitudinal direction over the outer surface of the sidewalls of said first valve body portion, said second valve body portion having a number of cutaway sections in the sidewalls at one end thereof, the number of said cutaway sections being sufficient in number, shape and position to receive each said arm protruding from the sidewalls of said first valve body portion when said first valve body is inserted in said second valve body portion, said second valve body portion having a length sufficient to cover said port opening when each said arm is positioned outside a said cutaway section, and short enough not to cover said port opening when each said arm is positioned within a said cutaway section, said second valve body portion also having a circular rim encircling the outer surface thereof positioned near but spaced from said cutaway sections and having an outside diameter sufficient to bridge the opening in said container but not enough to extend beyond the neck on said container; and (c) a threaded cap having an opening therein adapted to accommodate the outside of said second valve body portion and to rest on said circular rim on said second valve body portion, the threaded portion of said cap being adapted to fit onto the threaded neck of said container whereby the rim of said second valve body portion is tightly fitted between said cap and the upper rim on said neck of said container when said cap is screwed tightly on said threaded neck;

in which pour spout there is a first vent tube portion in said first valve body portion having an opening extending through the sidewall thereof at a level which will be exposed when each said arm is completely in a said cutaway section and said vent tube portion extending a distance therefrom to a second opening extending through said sidewall in said first valve body portion and there is a second vent tube portion in said second valve body portion positioned on the outside of said second valve body portion, said second vent tube portion extending in a direction substantially parallel to the longitudinal axis of said second cylindrical cavity in said second valve body portion, one end of said second vent tube portion being joined to a third opening extending to the inside of said second cylindrical cavity in said second valve body portion, said third opening being positioned so that it will be adjacent to and joined with said second opening in said sidewall of said first valve body portion when each said arm is positioned completely within a said cutaway section.

4. The pour spout of claim 3 in which there are two said arms.

5. The pour spout of claim 4 in which there is a removable cap on the end of said first valve body portion closest to said protruding arms.

6. The pour spout of claim 4 in which said bottom of said first valve body portion is a removable cap.

7. The pour spout of claim 4 in which said arms have gripper teeth on the surface thereof.

8. The pour spout of claim 4 in which said arms each have a slanted portion on the surface of said arms closest to said first valve body portion, said slanted portion slanting downward from a raised portion of said arm adjacent to the first valve body portion and slanting downward to a point on the arm farther removed from the first valve body portion.

9. The pour spout of claim 4 in which said first valve body portion has a button extending outward on the outer surface thereof of a size and shape to snap into the open end of said second vent tube portion when said open end is positioned in juxtaposition thereto.

10. The pour spout of claim 4 in which said button is positioned to snap into said third opening when said arms are positioned above said cutaway sections.

11. The pour spout of claim 10 in which there is a second said button positioned and adapted to snap into said third opening when said arms are positioned away from said cutaway sections.

* * * * *